United States Patent [19]

Lawrence et al.

[11] Patent Number: 5,017,251

[45] Date of Patent: May 21, 1991

[54] SHOCK-RESISTANT, LOW DENSITY EMULSION EXPLOSIVE

[75] Inventors: Lawrence D. Lawrence, Sandy; Walter B. Sudweeks, Orem, both of Utah

[73] Assignee: IRECO Incorporated, Salt Lake City, Utah

[21] Appl. No.: 457,085

[22] Filed: Dec. 26, 1989

[51] Int. Cl.[5] ..... C06B 45/00

[52] U.S. Cl. ..... 149/2; 149/21; 149/46; 149/44; 149/60; 149/61; 149/76; 149/83; 149/85

[58] Field of Search ..... 149/2, 21, 46, 60, 44, 149/61, 76, 83, 85

[56] References Cited

U.S. PATENT DOCUMENTS

| | | | |
|---|---|---|---|
| 4,303,731 | 12/1981 | Torobin | 149/2 |
| 4,435,232 | 3/1984 | Ciaramitaro et al. | 149/2 |
| 4,474,628 | 10/1984 | Sudweeks et al. | 149/2 |

*Primary Examiner*—Stephen J. Lechert, Jr.

[57] ABSTRACT

The present invention relates to an improved permissible explosive composition. More particularly, the invention relates to a permissible water-in-oil emulsion explosive that is shock-resistant and has a relatively low density. The water-in-oil emulsion explosives of this invention contain a water-immiscible organic fuel as the continuous phase and an emulsified inorganic oxidizer salt solution as the discontinuous phase. These oxidizer and fuel phases react with one another upon initiation by a blasting cap or other initiator to produce an effective detonation.

11 Claims, No Drawings

SHOCK-RESISTANT, LOW DENSITY EMULSION EXPLOSIVE

BACKGROUND OF THE INVENTION

The term "permissible" describes explosives that are cap-sensitive and relatively non-incendive so that they can be used in the underground mines having potentially flammable atmospheres, such as underground coal mines. The Mine, Safety and Health Administration of the United States Department of Labor has established detailed requirements for approval of permissible explosives for underground use. These requirements are published in 30 C.F.R. Part 15. These regulations, which are incorporated herein by reference, define permissible explosives in terms of stringent minimum performance requirements.

By "low density" is meant explosives having a bulk density of less than 1.0 g/cc, and preferably about 0.9 g/cc. The low density explosives of the present invention have lower detonation velocities and bulk energies than higher density couterparts. For example, prior art compositions generally have densities above 1.0 g/cc and detonation velocities of about 4,700 m/sec or higher; whereas, the present compositions have densities below 1.0 g/cc and velocities of about 4,200 m/sec or less. This is advantageous for blasting in coal mines where lumps rather than finer fragments generally are desired. The low velocity allows for a heaving rather than shattering action on the soft coal body. A lower detonation velocity also correlates generally with less incendivity which also is desirable for permissible blasting applications. Shock resistance is provided in the present invention by the use of relatively high strength glass or plastic hollow spheres. By "shock-resistant" is meant the ability to withstand shock wave desensitization that commonly is referred to as "dead pressing." The use of high strength hollow spheres to prevent dead pressing in slurry explosives is disclosed in U.S. Pat. No. 4,474,628. The hollow spheres for use in the present invention need to have a strength sufficient to withstand or resist the shock from a neighboring detonation, or in other words, to resist dead pressing. But high strength hollow spheres, by themselves, do not impart enough sensitization to the explosives of the present invention.

In order to achieve shock resistance and adequate sensitivity for permissible applications, it has been found necessary to use both high strength hollow spheres for shock resistance and chemically produced gas bubbles for sensitivity. If only high strength hollow spheres are used to reduce the density of the explosive and thereby increase its sensitivity, the sensitivity is not increased sufficiently to meet the permissibility requirements. Moreover, high strength hollow spheres are relatively expensive, particularly if used as the sole density reducing means. On the other hand, gas bubbles alone can achieve the required sensitivity levels, but they do not provide sufficient resistance to dead pressing or shock. Thus it has been found in the present invention that lowering the density to the required range by the combination of high strength hollow spheres and chemically produced gas bubbles provides the necessary shook resistance and detonation sensitivity, and also imparts a lower detonation velocity to the explosive.

Although the combination of gas bubbles and hollow spheres for density reduction in emulsion explosives has been previously suggested, for example see U.S. Pat. Nos. 4,594,118 and 4,474,628, the use of high strength hollow spheres in combination with chemical gassing to produce a low density, shock-resistant permissible emulsion explosive is not disclosed in the prior art.

Although most prior art compositions have densities greater than 1.05 g/cc, lower density ranges also have been disclosed generally in certain prior art patents, for example, U.S. Pat. Nos. 4,790,891; 4,737,207; 4,711,678; 4,594,118; 4,566,920; 4,547,234; 4,394,198; 4,383,873; 4,287,010; 4,149,917; 4,110,134; 3,642,547; 4,322,258; 4,216,040; and 4,141,767. Here again, none of these references disclose the combination of the present invention, and particularly not in a permissible composition.

SUMMARY OF THE INVENTION

The invention is a shock-resistant permissible emulsion explosive comprising a water immiscible organic fuel as a continuous phase; an emulsified aqueous inorganic oxidizer salt solution as a discontinuous phase; an emulsifier; from about 1% to about 10% by weight of the explosive of small, hollow, dispersed spheres having a strength such that a maximum of about 10% of the spheres by volume collapse under a pressure of 500 psi; and sensitizing gas bubbles dispersed throughout the explosive and produced by the reaction of chemical gassing agents, in an amount sufficient to reduce the density of the explosive to less than 1.0 g/cc. The high strength hollow spheres provide sufficient shock resistance to prevent dead pressing and the chemical gassing provides sufficient sensitivity to meet the permissibility requirements.

DETAILED DESCRIPTION OF THE INVENTION

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitro-compounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to 15% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate, but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred.

Water generally is employed in an amount of from 5% to about 30% by weight based on the total composition. It is commonly employed in emulsions in an amount of from about 9% to about 20%.

Water-miscible organic liquids can at least partially replace water as a solvent for the salts, and such liquids also function as a fuel for the composition. Moreover, certain organic compounds reduce the crystallization temperature of the oxidizer salts in solution. Miscible solid or liquid fuels can include alcohols such as sugars and methyl alcohol, glycols such as ethylene glycols, amides such as formamide, urea and analogous nitrogen-containing fuels. As is well known in the art, the amount and type of water-miscible liquid(s) or solid(s) used can vary according to desired physical properties.

The emulsifier can be selected from those conventionally used, and various types are listed in the above-listed patents. Preferably, the emulsifier is selected from the group consisting of a bis-alkanolamine or bis-polyol derivative of a bis-carboxylated or anhydride derivatized olefinic or vinyl addition polymer, sorbitan fatty esters, carboxylic acid salts, substituted oxazoline, alkyl amines or their salts, and derivatives thereof. The emulsifier preferably is used in an amount of from about 0.2% to about 5%. Mixtures of emulsifiers can be used.

The compositions of the present invention are reduced from their natural densities by addition of density reducing agents of a type and in an amount sufficient to reduce the density to less than 1.0 g/cc. This density reduction is accomplished by the combination of high strength hollow spheres and chemically produced gas bubbles.

The hollow spheres preferably are glass, although high strength plastic or perlite spheres also can be used. The spheres must have a strength sufficient to prevent or minimize dead pressing. This strength is such that a maximum of about 10% of the spheres by volume collapse under a pressure of 500 psi. (The percentage and pressure nominal values may vary ±20%.) The spheres, if glass, generally have a particle size such that 90% by volume are between 20 and 130 microns.

The spheres are used in an amount of from about 1% to about 10%, which generally reduces the density of the explosive to a range of from about 1.10 g/cc to about 1.35 g/cc. The primary purpose for using these spheres, as previously described, is to provide shock resistance against dead pressing. A secondary purpose is to sensitize the explosive to initiation, although such high strength spheres generally will not impart sufficient sensitivity to the explosive for it to meet the permissibility requirement. This additional sensitivity is provided by a chemical gassing agent(s).

Chemical gassing agents preferably comprise sodium nitrite, that decomposes chemically in the composition to produce gas bubbles, and a gassing accelerator such as thiourea, to accelerate the decomposition process. A sodium nitrite/thiourea combination produces gas bubbles immediately upon addition of the nitrite to the oxidizer solution containing the thiourea, which solution preferably has a pH of about 4.5. The nitrite is added as a diluted aqueous solution in an amount of from less than 0.1% to about 0.4% by weight, and the thiourea or other accelerator is added in a similar amount to the oxidizer solution. Other gassing agents can be employed.

The explosives of the present invention may be formulated in a conventional manner. Typically, the oxidizer salt(s) first is dissolved in the water (or aqueous solution of water and miscible liquid fuel) at an elevated temperature of from about 25° C. to about 90° C. or higher, depending upon the crystallization temperature of the salt solution. The aqueous solution, which may contain any gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. The solid ingredients, including any solid density control agent, and remaining gassing agents then are added and stirred throughout the formulation by conventional means. Since the gassing reaction occurs rapidly, packaging should immediately follow the addition of the gassing agent, although the gassing rate can be controlled to some extent by pH adjustments. The formulation process also can be accomplished in a continuous manner as is known in the art. Also, the solid density control agent may be added to one of the two liquid phases prior to emulsion formation.

It has been found to be advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

Reference to the following Tables further illustrates the invention.

In all of the examples in Table I, dead pressing distances are given. The dead pressing distances were obtained by suspending vertically parallel in water two charges, a donor charge and an acceptor charge, and initiating the donor charge prior to the acceptor charge. During the testing, the composition of the donor charges remained constant. The dead pressing distances are the distances which separated the charges, with the first number indicating the distance at which a successful detonation of the acceptor or delayed charge occurred, and the second number indicating the distance at which the acceptor (250 milliseconds) charge failed. The shorter the distance for a successful detonation, the more resistant the explosive is to dead pressing.

Example A had essentially the same basic formulation as the other examples except that it contained lower strength glass microspheres having a strength less than that required by the present invention. It was highly susceptible to underwater dynamic shock desensitivity, and thus had poor shock-resistance.

Example B likewise had poor shock-resistance, even though it had a combination of low-strength glass microspheres, chemical gassing agents and a lower density.

Example C contained high strength microballoons but no chemical gassing agents, and although it had an improved shock-resistance, its density was relatively high as was its detonation velocity. In comparison, Example F contained both high strength glass microspheres and chemical gassing agents, had a lower density of 1.05 g/cc and had a lower detonation velocity of 4,200 m/sec. Accordingly, it had a considerably improved shock-resistance as indicated in the detonation results, and a density below 1.0 g/cc would have produced even better results.

Example D had even higher strength microballoons than Examples C and F, but no chemical gassing agents. Consequently, it failed even to detonate. Example G, employing the same higher strength microballoons as in Example D, but with chemical gassing agents added, had the best shock-resistance of all the examples, along with a desired low density of 0.95 g/cc and a low detonation velocity of 3,900 m/sec. Examples E and H illustrate the same effect with respect to ceramic microspheres.

Table II further illustrates the effect on detonation velocity by lowering density from above 1.0 g/cc to below that figure.

While the present invention has been described with reference to certain illustrative examples and preferred embodiments, various modifications will be apparent to those skilled in the art and any such modifications are intended to be within the scope of the invention as set forth in the appended claims.

TABLE I

| | A | B | C | D | E | F | G | H |
|---|---|---|---|---|---|---|---|---|
| AN (percentage by weight) | 68.3 | 68.6 | 67.5 | 67.5 | 65.6 | 67.8 | 67.8 | 66.2 |
| SN | 12.7 | 12.8 | 12.6 | 12.6 | 12.3 | 12.7 | 12.6 | 12.4 |
| $H_2O$ | 10.0 | 10.0 | 9.9 | 9.9 | 9.6 | 9.9 | 9.9 | 9.7 |
| Gassing accelerator[a] | 0.2 | 0.2 | 0.2 | 0.2 | 0.2 | 0.2 | 0.2 | 0.2 |
| Sorbitan monooleate | 1.9 | 1.9 | 1.9 | 1.9 | 1.9 | 1.9 | 1.9 | 1.9 |
| Mineral oil | 0.6 | 0.6 | 0.6 | 0.6 | 0.6 | 0.6 | 0.6 | 0.6 |
| Paraffin | 1.9 | 1.9 | 1.9 | 1.9 | 1.9 | 1.9 | 1.9 | 1.9 |
| Microcrystalline wax | 1.9 | 1.9 | 1.9 | 1.9 | 1.9 | 1.9 | 1.9 | 1.9 |
| C15/250[b] | 2.5 | 2.0 | — | — | — | — | — | — |
| B23/500[c] | — | — | 3.5 | — | — | 3.0 | — | — |
| B37/2000[d] | — | — | — | 3.5 | — | — | 3.0 | — |
| Extendosphere DSG[e] | — | — | — | — | 6.0 | — | — | 5.0 |
| Sodium nitrite solution (20%) | — | 0.1 | — | — | — | 0.1 | 0.2 | 0.2 |
| Density (g/cc) | 1.15 | 1.05 | 1.18 | 1.27 | 1.30 | 1.05 | 0.95 | 1.05 |
| 32 mm × 400 mm charges | | | | | | | | |
| Detonation Results at 0-5° C. | | | | | | | | |
| Detonation velocity (m/sec) | 4,700 | 4,500 | 4,700 | F | F | 4,200 | 3,900 | 3,800 |
| Underwater dynamic shock distance (det/fail) cm[f] | 198/188 | 198/188 | 76/66 | — | — | 66/41 | 30/15 | 41/30 |

Key:
[a]Thiourea or equivalent
[b]Glass microspheres of 3M Company; less than 10% will collapse at a pressure of 250 psi
[c]Glass microspheres of 3M Company; less than 10% will collapse at a pressure of 500 psi
[d]Glass microspheres of 3M Company; less than 10% will collapse at a pressure of 2000 psi
[e]Ceramic microspheres
[f]When subjected to the detonating shock impulse of a donor charge one meter deep under water using a 25-250 millisecond delay detonator in the acceptor charge

TABLE II

| | A | B | C | D | E | F |
|---|---|---|---|---|---|---|
| AN (parts by weight) | 68.50 | 68.50 | 68.50 | 68.50 | 68.50 | 68.50 |
| SN | 12.84 | 12.84 | 12.84 | 12.84 | 12.84 | 12.84 |
| $H_2O$ | 10.08 | 10.08 | 10.08 | 10.08 | 10.08 | 10.08 |
| Gassing accelerator[a] | 0.28 | 0.28 | 0.28 | 0.28 | 0.28 | 0.28 |
| Sorbitan monooleate | 1.83 | 1.83 | 1.83 | 1.83 | 1.83 | 1.83 |
| Mineral oil | 0.61 | 0.61 | 0.61 | 0.61 | 0.61 | 0.61 |
| Microcrystalline wax | 1.83 | 1.83 | 1.83 | 1.83 | 1.83 | 1.83 |
| Paraffin | 1.83 | 1.83 | 1.83 | 1.83 | 1.83 | 1.83 |
| B23/500[b] | 2.00 | 2.00 | — | — | — | — |
| B37/2000[c] | — | — | 2.00 | 2.00 | — | — |
| Extendosphere DSG[d] | — | — | — | — | 2.00 | 2.00 |
| Sodium nitrite solution (20%) | 0.20 | 0.40 | 0.20 | 0.40 | 0.20 | 0.40 |
| Density (g/cc) | 1.10 | 0.86 | 1.13 | 0.89 | 1.15 | 0.93 |
| 32 mm × 400 mm charges | | | | | | |
| Detonation Results at 0-5° C. | | | | | | |
| Detonation velocity of (m/sec) | 4,700 | 3,800 | 4,500 | 3,400 | 4,500 | 3,500 |

Key:
[a]Thiourea or equivalent
[b]Glass microspheres of 3M Company; less than 10% will collapse at a pressure of 500 psi
[c]Glass microspheres of 3M Company; less than 10% will collapse at a pressure of 2000 psi
[d]Ceramic microspheres

What is claimed is:

1. A shock-resistant permissible emulsion explosive comprising a water immiscible organic fuel as a continuous phase; an emulsified aqueous inorganic oxidizer salt solution as a discontinuous phase; an emulsifier; from about 1% to about 10% by weight of the explosive of small, hollow, dispersed spheres having a strength such that a maximum of about 10% of the spheres by volume collapse under a pressure of 500 psi; and sensitizing gas bubbles dispersed throughout the explosive and produced by the reaction of chemical gassing agents, in an amount sufficient to reduce the density of the explosive to less than 1.0 g/cc.

2. An explosive according to claim 1 wherein the spheres are glass.

3. An explosive according to claim 1 wherein the spheres are plastic.

4. An explosive according to claim 1 wherein the spheres are present in an amount sufficient to reduce the density of the explosive to within the range of from about 1.10 to about 1.35 g/cc.

5. An explosive according to claim 2 wherein the spheres have a particle size such that 90% by volume are between 20 and 130 microns.

6. An explosive according to claim 1 wherein the gas bubbles are produced by the chemical decomposition of a nitrite salt in an acidic inorganic oxidizer salt solution phase.

7. An explosive according to claim 6 in which the decomposition is accelerated by the addition of a catalyst.

8. An explosive according to claim 1 wherein the organic fuel is selected from the group consisting of mineral oil, waxes, benzene, toluene, xylene, and petroleum distillates such as gasoline, kerosene, and diesel fuels.

9. An explosive according to claim 1 wherein the inorganic oxidizer salt is selected from the group consisting of ammonium and alkali and alkaline earth metal nitrates, chlorates and perchlorates.

10. An explosive according to claim 1 wherein the liquid organic fuel is present in an amount from about 3% to about 10% by weight, the inorganic oxidizer salt solution comprises inorganic oxidizer salt in an amount of from about 45% to about 90% and water in an amount from about 9% to about 20%, and the emulsifier is present in an amount from about 0.2% to about 5%.

11. An explosive according to claim 1 wherein the emulsifier is selected from the group consisting of a bis-alkanolamine or bis-polyol derivative of a bis-carboxylated or anhydride derivatized olefinic or vinyl addition polymer, sorbitan fatty esters, carboxylic acid salts, substituted oxazoline, alkyl amines or their salts, and derivatives thereof.

* * * * *